US006705148B1

(12) United States Patent
McCorry et al.

(10) Patent No.: US 6,705,148 B1
(45) Date of Patent: Mar. 16, 2004

(54) END-FORMING OF CORRUGATED METAL FOIL WRAP TUBING

(75) Inventors: Timothy P. McCorry, Lapeer, MI (US); Russ Manning, Pontiac, MI (US); Randall F. Alder, Lapeer, MI (US)

(73) Assignee: Dana Corporation, Toledo, OH (US)

( * ) Notice: Subject to any disclaimer, the term of this patent is extended or adjusted under 35 U.S.C. 154(b) by 274 days.

(21) Appl. No.: 09/792,618

(22) Filed: Feb. 23, 2001

(51) Int. Cl.[7] ..... B21D 41/04
(52) U.S. Cl. ..... 72/370.1; 72/370.19
(58) Field of Search ..... 72/306, 370.1, 72/370.11, 370.12, 370.13, 370.19; 138/109; 493/292, 308

(56) References Cited

U.S. PATENT DOCUMENTS

| | | | | | |
|---|---|---|---|---|---|
| 1,168,462 | A | | 1/1916 | Batdorf | 53/285 |
| 1,774,851 | A | | 9/1930 | Stout | 229/93 |
| 2,163,806 | A | | 6/1939 | Pierce | 493/310 |
| 2,620,013 | A | * | 12/1952 | De Voss | 72/306 |
| 3,794,364 | A | * | 2/1974 | Williams | 138/109 |
| 4,044,581 | A | * | 8/1977 | Meserole | 72/370.19 |
| 4,411,048 | A | | 10/1983 | Green | 493/308 |
| 4,536,175 | A | | 8/1985 | Arnold | 493/308 |
| 4,590,785 | A | * | 5/1986 | Morris | 72/370.19 |
| 5,885,676 | A | | 3/1999 | Lobo et al. | 428/36.9 |

OTHER PUBLICATIONS

Clevaflex Convoluted Multi–Ply Shielding, Nov. 29, 2000 (www.clevaflex.com).

* cited by examiner

*Primary Examiner*—Lowell A. Larson
(74) *Attorney, Agent, or Firm*—Reising, Ethington, Barnes & Kisselle, P.C.

(57) ABSTRACT

A method and apparatus for forming the free end of a length of metal foil wrap corrugated tubing, in which a free end of the tubing is first crimped against a mandrel, then folded to extend radially inwardly, then folded further to extend axially inwardly within the inside diameter of the tubing end, and then compacted axially to bring the corrugations into facing abutment with each other and tighten the formed end of the tubing against unwrapping of the metal foil. The crimping operation involves closure of a plurality of jaws around the free end of the tubing and deforming the tubing end against a tapering surface on an internal mandrel. The tubing is then gripped between jaws that form a radially indented channel in the periphery of the tubing, both to enhance the clamping action of the jaws and to isolate the formed end of the tubing from the remainder of the tubing. The clamped length of tubing is then engaged by a folding tool to fold the crimped end of the tubing radially inwardly, and then by a compacting tool further to fold the end axially into the tubing and then to compact the end portion of the tubing to form a tight tubing end joint.

14 Claims, 5 Drawing Sheets

END-FORMING OF CORRUGATED METAL FOIL WRAP TUBING

The present invention is directed to terminating the ends of lengths of corrugated metal foil wrap tubing, and more particularly to a method and apparatus for end-forming such tubing.

BACKGROUND AND SUMMARY OF THE INVENTION

Metal foil wrap corrugated tubing, also referred to as convoluted multi-ply shielding, has been employed as a protective sheathing in automotive and other applications. For example, metal foil wrap tubing is employed to protect delicate or thermally sensitive items, such as electrical wires, fuel lines and plastic tubes with low heat resistance, from exterior abrasion or heat. Metal foil wrap corrugated tubing is also employed to sheathe high temperature tubes, such as tubes conducting exhaust gas, from adjacent exterior thermally sensitive items such as electrical wires and fuel lines. Such metal foil wrap corrugated tubing may be readily bent and formed around objects and turns, and provides good protection against abrasion of the internal electrical wires. One line of metal foil wrap corrugated tubing is marketed by Clevaflex, Ltd. of Cleveland, Ohio. In general, such tubing comprises an elongated strip of layered material, including metal such as stainless steel, spirally wound into a tube, mechanically locked in place by microcorrugations and bonded with a thermosetting adhesive. When the tubing is cut to desired length, steps must be taken to prevent unwrapping at the end of the spirally wrapped corrugated metal, particularly at high temperatures at which the adhesive may lose adhesion. This is conventionally accomplished by crimping or otherwise securing an end cap or ferrule to the end of the tube. These end caps are expensive relative to the cost of the tubing itself.

It is therefore a general object of the present invention to provide a method and apparatus for forming the end of a length of metal foil wrap corrugated tubing that prevent unwrapping at the tubing end, that do not damage the tubing length, and that are adapted for automated implementation. Another object of the invention is to provide a length of metal foil wrap corrugated tubing having a formed end to prevent unwrapping of the tubing material, but without use of additional components such as the conventional end caps.

A method of forming an end of corrugated metal foil wrap tubing in accordance with one aspect of the present invention includes providing a length of tubing having a sidewall with spaced corrugations and folding a portion of the end of the tubing into the sidewall to form a sidewall end portion of inner and outer layers. The sidewall end portion is preferably additionally axially compacted by axially compressing the end portion to bring the corrugations into axial abutment. The end portion of the tubing preferably is folded inwardly into itself by bringing the end portion into axial engagement with a folding tool. In the preferred embodiment of the invention, this axial engagement is continued to compact the end portion of the tube in an annular end channel on the compacting tool. By folding the tubing end inwardly upon itself and then axially compacting the corrugations as in the preferred embodiment of the invention, a tight end joint is formed to resist unwrapping or unraveling of the metal foil.

In the preferred embodiment of the invention, a length of metal foil wrap corrugated tubing is clamped between jaws for holding the tubing during contact with the compacting tool. These jaws preferably are provided as an opposed set of jaws that have rib segments which, when the jaws are closed around the tubing, form a circumferentially continuous rib to indent a channel around the periphery of the tubing adjacent to the end portion of the tubing. This channel serves both to enhance clamping of the tubing between the jaws against axial forces applied to the tubing by the compacting tool, and to isolate the end portion of the tubing from the remainder of the tubing length during the end-forming operation. In the preferred embodiment of the invention, the compressing operation is preceded by a folding operation, in which the end of the tubing is brought into engagement with a fold-over tool that folds the end of the tubing radially inwardly. This folded portion of the tubing is then engaged by a horn that extends axially from the compacting tool further to fold the end axially into the tubing end portion prior to engagement of the tubing with the channel in the compacting tool. The same set of clamping jaws may be employed to clamp the tubing during both the folding and the compacting operations. In the preferred embodiment of the invention, the folding operation is preceded by a crimping operation, in which the end of the tubing is crimped radially inwardly by a plurality of crimping jaws acting against a conical surface on a mandrel within the tubing.

Thus, in its most preferred form, the present invention provides a method for forming a free end of a length of metal foil wrap corrugated tubing in which the free end of the tubing is first crimped against a mandrel, then folded to extend radially inwardly, then folded further to extend axially inwardly within the inside diameter of the tubing end, and then compacted axially to bring the corrugations into facing abutment with each other and tighten the formed end of the tubing against unraveling of the metal foil. The crimping operation involves closure of a plurality of jaws around the free end of the tubing and deforming the tubing end against a tapering surface on an internal mandrel. The tubing is then gripped between jaws that form a radially indented channel in the periphery of the tubing, both to enhance the clamping action of the jaws and to isolate the formed end of the tubing from the remainder of the tubing. The clamped length of tubing is then engaged by a fold-over tool to fold the crimped end of the tubing radially inwardly, and then by a compacting tool further to fold the end axially into the tubing and then to compact the end portion of the tubing to form a tight tubing end joint.

Apparatus for forming an end-of corrugated metal foil wrap tubing in accordance with the preferred embodiment of another aspect of the invention includes a set of jaws for closing around a length of foil wrap tubing to clamp the tubing, and for opening to release the tubing. A compacting tool has an axially extending horn and an annular axially facing end channel. The compacting tool is brought into engagement with an end portion of a length of tubing in the jaws so as to fold the end portion into itself and compact the end portion by axially compressing the end portion to bring corrugations in the end portion into axial abutment with each other. In the preferred embodiment of the invention, the apparatus also includes a folding tool having an annular axially facing end channel. The folding tool is brought into axial engagement with the end of the tubing, prior to the compacting tool, so as to fold a portion of the end radially inwardly. Subsequent engagement by the compacting tool deforms this portion of the tubing end axially inwardly by contact with the horn on the compacting tool, and then axially compacts the end portion by engagement with the end channel in the compacting tool. The jaws preferably have arcuate rib segments that, when the jaws are clamped around a length of tubing, form a circumferentially continuous rib that indents a circumferential channel in the tubing to grip the tubing and to isolate the end portion from the remainder of the tubing.

A length of corrugated metal foil wrap tubing in accordance with a third aspect of the present invention has a formed end that includes an external end portion in which tubing corrugations are axially compacted together, and an internal end portion integrally folded inward from an axial end of the external end portion and in radially internal abutment with the external end portion. The formed end preferably also has a circumferential channel in the tubing separating the form end from the remainder of the tubing length.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
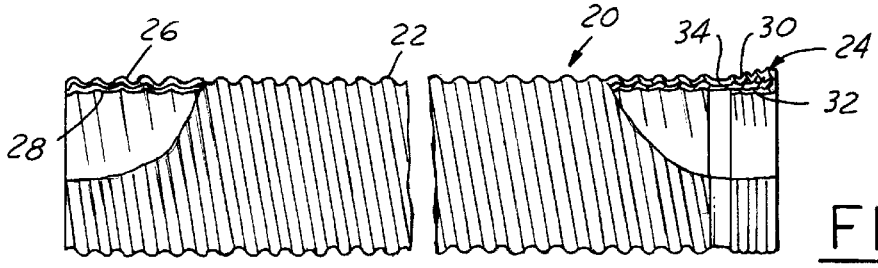
FIG. 1 is a partially sectioned side elevational view of a length of corrugated metal foil wrap tubing having a formed end in accordance with a presently preferred embodiment of the invention.

FIG. 1 illustrates a length 20 of metal foil wrap corrugated tubing 22, also referred to as convoluted multi-ply shielding, having a formed end 24 in accordance with the preferred embodiment of the present invention. Tubing 22 comprises a strip of corrugated metal foil spirally wrapped on itself to form a hollow cylindrical tube, in which the corrugations form axially spaced spiral undulations in the outer and inner surfaces of the tube. An inner ply 28 of fiberglass cloth or the like is captured by spiral wrapping to form the interior wall of the tube as formed. Metal foil wrap corrugated tubing is typically supplied in large rolls, and is cut to desired lengths by the user. Such tubing is employed as a sheathing for electrical wires or fuel lines in automotive applications, for example. The metal foil wrap protects the wires from abrasion, and the foil corrugations add strength to the tubing. The inner fiberglass cloth layer protects the electrical wires from abrasion against the inside edges of the metal foil wrap. This tubing may also be used to cover high heat emitting products, such as exhaust-carrying tubes, to retain their heat and thereby protect surrounding components from this heat. A tube length may be readily bent to desired geometry and will retain this geometry when released. The particular tubing 22 illustrated in the drawings is manufactured by Clevaflex, identified above. However, the present invention is in no way limited to use in conjunction with this particular brand of metal foil wrap corrugated tubing, and can be readily employed in conjunction with tubing provided by other manufacturers.

Figure 1A:
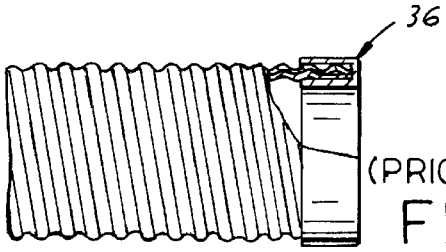
(PRIOR ART) FIG. 1A
FIG. 1A is a partially sectioned elevation view similar to that of FIG. 1 but showing a length of corrugated metal foil wrap tubing having an end cap in accordance with the prior art.

In accordance with the preferred embodiment of the invention, formed end 24 includes an external end portion 30 in which the metal foil wrap corrugations are axially tightly compressed against each other, and an internal end portion 32 integrally folded inwardly from the axial end of external end portion 30. (There is cloth material 28 sandwiched between portions 30, 32.) Internal end portion 32 is in radially internal abutment with the inside surface of external end portion 30, and is essentially cylindrical, with the corrugations having been at least partially removed during the end-forming process to be described. Formed end 24 includes a circumferential channel 34 extending around tubing 22 separating formed end 24 from the body of the tubing. Channel 34 is formed to help clamp the tubing body during the end-forming operation, and helps isolate forces applied during the end-forming operation from the remainder of the tube body. The compacted corrugations of outer end portion 30, coupled with the inwardly folded inner end portion 32, prevent unwrapping of the foil metal strip, and eliminate the need for the end cap or ferrule 36 typically employed at the ends of corrugated metal tubing, as illustrated in FIG. 1A.

Figure 2:
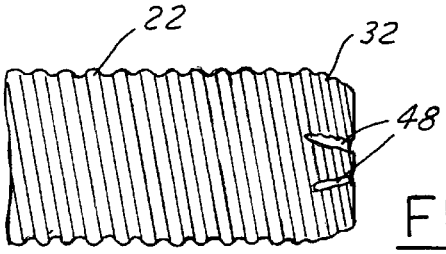
FIGS. 2–4 are fragmentary side elevational views of a tubing formed end at successive intermediate stages of manufacture.
Figure 3:
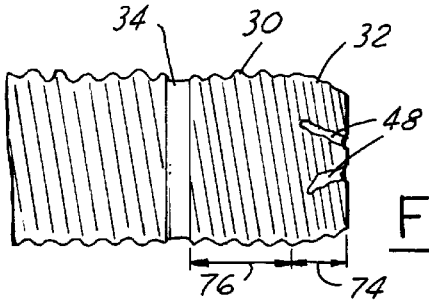
Figure 10:
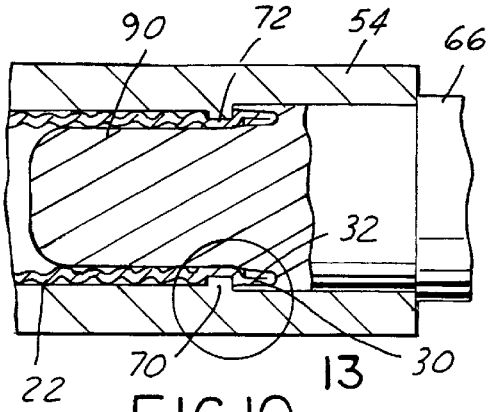
FIG. 10 is a fragmentary sectional view of the tubing end engaged by the compacting tool in FIG. 7.
Figure 10A:
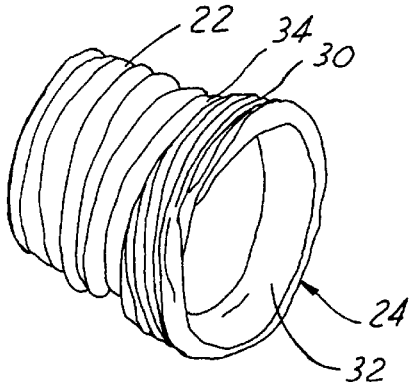
FIG. 10A is a fragmentary perspective view of the formed tubing end after compaction in FIG. 10.
Figure 11:
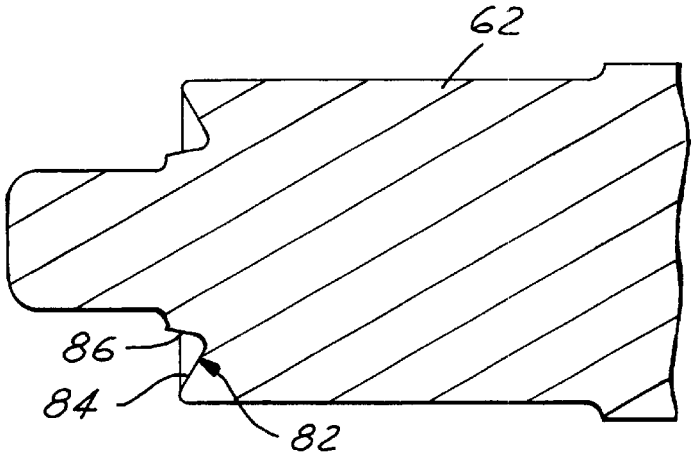
FIG. 11 is a fragmentary sectional view of the fold-over tool illustrated in FIGS. 7 and 9.
Figure 12:
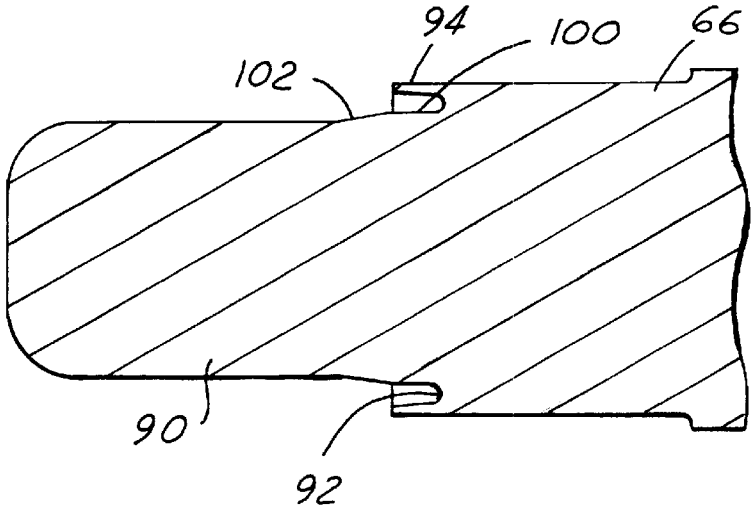
FIG. 12 is a fragmentary sectional view of the compacting tool illustrated in FIGS. 7 and 10.

As summarized above, the end-forming operation in accordance with the most preferred embodiment of the invention disclosed in this application involves four steps: (1) The cut end of a length of tubing is crimped over a mandrel (FIGS. 5A–6) so that the crimped end tapers radially inwardly (FIG. 2) and end material is gathered in ridges to facilitate subsequent steps of the forming operation. (2) The crimped end of the tubing is clamped between jaws (FIGS. 7–8A) to hold the tube end during subsequent operations and to form a recessed channel or groove (FIGS. 3 and 8A) that extends around the tubing adjacent to the end. (3) The clamped end of the length of tubing is engaged by a fold-over tool (FIGS. 7, 9 and 11) to fold the crimped end portion radially inwardly (FIGS. 4 and 9A) toward the axis of the tubing. (4) The partially folded end portion of the tubing is engaged by a compacting tool (FIGS. 7, 10 and 12–13) further to fold the partially folded end portion of the tube axially inwardly against the inside diameter of the tubing end (FIGS. 1 and 10A) and to compact the corrugations of the tubing end to form a tight end joint.

Figure 5A:
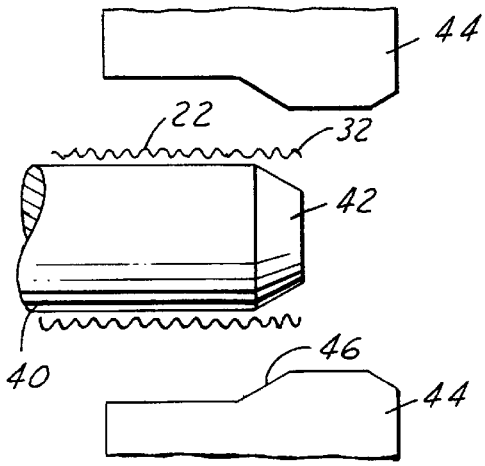
FIGS. 5A and 5B are schematic diagrams of a tubing end crimping die in accordance with a presently preferred embodiment of the invention.
Figure 5B:
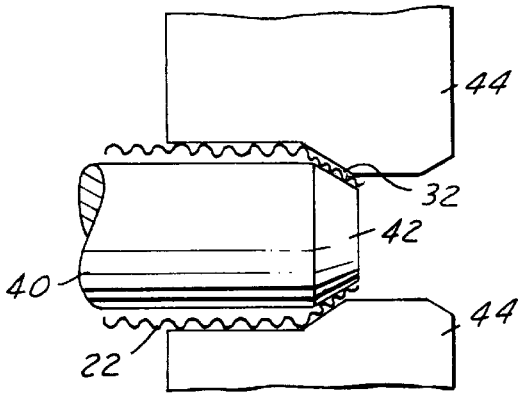
Figure 6:
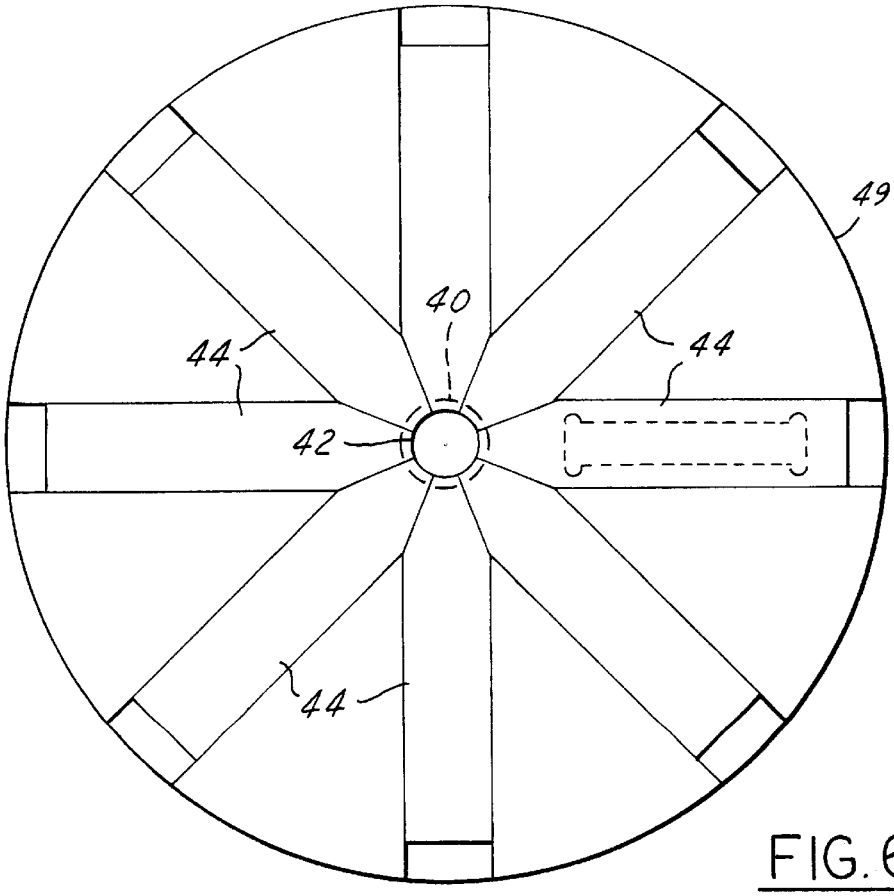
FIG. 6 is a schematic end elevational view of the crimping die arrangement illustrated in FIGS. 5A and 5B.

Referring first to FIGS. 5A–6, the cut end of a length of tubing 22 is placed over a cylindrical support bar or a mandrel 40. Mandrel 40 has a conical end surface 42 at an angle, such as 30°, to the axis of the mandrel. Tubing end portion 32 radially overlies conical mandrel surface 42 and is radially spaced therefrom owing to the initially cylindrical contour of tubing 22 and tubing end portion 32. Mandrel 40 and tubing 22 are then placed within a circumferential array of forming dies or jaws 44. Each jaw 44 has a part-conical forming surface 46 that, together with the forming surfaces 46 of the other jaws 44, form a cone surrounding mandrel surface 42. Jaws 44 are then closed, from the positions of FIG. 5A to the positions of FIGS. 5B and 6, so as to crimp or deform tubing end portion 32 against surface 42 of mandrel 40. During this crimping operation, reduction in diameter of tubing end portion 32 causes material to gather in creases 48 (FIG. 2), which generally coincide with the boundaries or edges between surface portions 46 of jaws 44. The corrugations in end portion 32 are at least partially flattened during the crimping operation. Crimping jaws 44 may be moved radially inwardly and outwardly by any suitable camming means 49 well known in the art.

Figure 7:
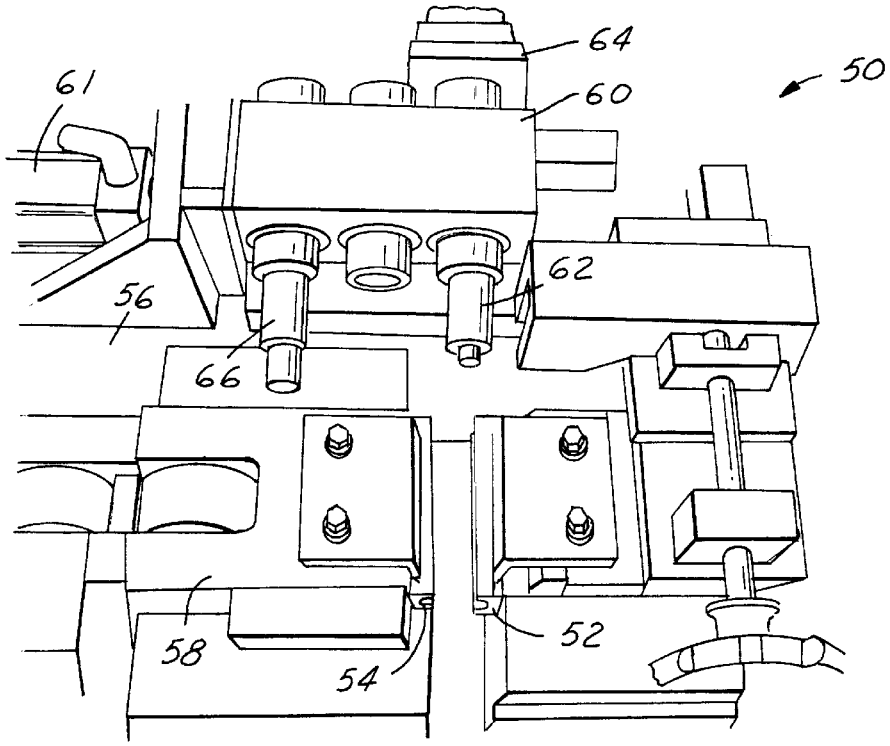
FIG. 7 is a perspective view of an apparatus for folding and compacting the formed end of a length of corrugated metal foil wrap tubing in accordance with a presently preferred embodiment of the invention.

FIG.7 illustrates a presently preferred apparatus 50 for performing the remaining operations of the end-forming process in accordance with the presently preferred embodiment of the invention. A pair of clamping jaws 52, 54 are mounted on a die bed 56. Jaw 52 is mounted in fixed position, while jaw 54 is mounted on a support 58 that is movable on bed 56 into and out of opposed engagement with jaw 52 for clamping a tubing workpiece therebetween. A shuttle 60 is movably mounted on bed 56 under control of an actuator 61. Shuttle 60 carries a fold-over end-form tool 62 that is movable in the direction of its axis under control of an actuator 64, and a compacting end-form tool 66 that is movable in the direction of its axis under control of actuator 64 when shuttle 60 is moved to bring tool 66 into alignment with actuator 64. Actuators 61, 64 may be of any suitable hydraulic, pneumatic or electric type. In general, jaw 54 is movable toward jaw 52 to clamp a tubing workpiece for performing the end-forming operation. With shuttle 60 in the position illustrated in FIG. 7, fold-over end-form tool 62 is then brought into axial engagement with the end of the tubing clamped between jaws 52, 54 for performing the fold-over operation to be described. Fold-over tool 62 is then retracted, and shuttle 60 is moved laterally (to the right in FIG. 7) to bring compacting end-form tool 66 into axial alignment with the workpiece between jaws 52, 54 and with actuator 64. Actuator 64 is then actuated to bring compacting end-form tool 66 into engagement with the end of the tubing workpiece clamped between the jaws. End-form tool 66 is then retracted and jaw 54 is opened to release the workpiece.

Figure 8:
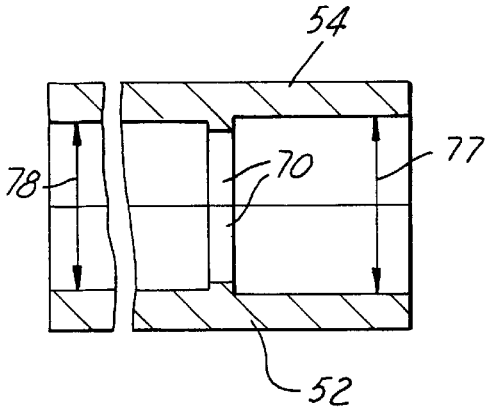
FIG. 8 is a fragmentary sectional view of the clamping dies in FIG. 7.
Figure 8A:
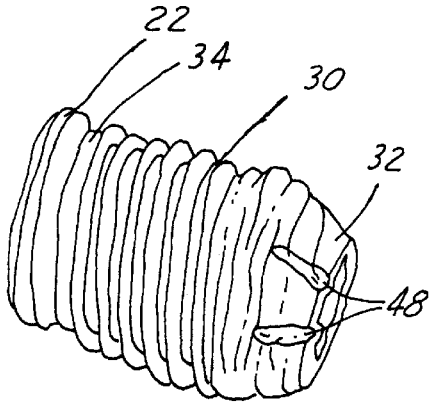
FIG. 8A is a fragmentary perspective view of a tubing formed end at the intermediate stage of manufacture after crimping and clamping in the forming die.

As illustrated in FIG. 8, each workpiece clamping jaw 52, 54 has a radially inwardly extending rib segment 70 that, when jaws 52, 54 are closed, forms a circumferentially continuous rib that extends radially inwardly into engagement with a tubing workpiece clamped between the jaws. This rib 70 forms circumferentially continuous channel 34 (FIGS. 3 and 8A) in the tubing workpiece. Ribs 70 and channel 34 help clamp the tubing workpiece during axial engagement of the tubing end by the forming tools, as will be described. Channel 34 also helps isolate the remainder of the tubing body from the forces applied by the end-forming tools. It will be noted in FIG. 3 that the length 74 of crimped end portion 32 at the tubing end is considerably less than the length 76 of the uncrimped end portion 30 of the tubing end extending between the crimped portion and channel 34. In a working embodiment of the invention, length 76 is about twice as great as length 74 at this stage of manufacture. In general, as will be described, length 74 is folded inward to form internal end portion 32 (FIG. 1) and length 76 is compacted to form external end portion 30. It will also be noted in FIG. 8 that the inside diameter of jaws 52, 54 is slightly greater at 77 adjacent to tools 62, 66 than at 78 at the opposing side of rib 70.

Figure 4:
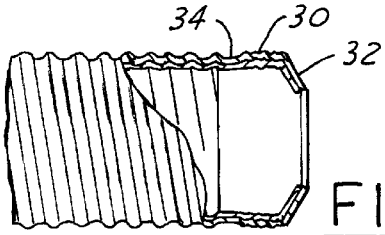
Figure 9:
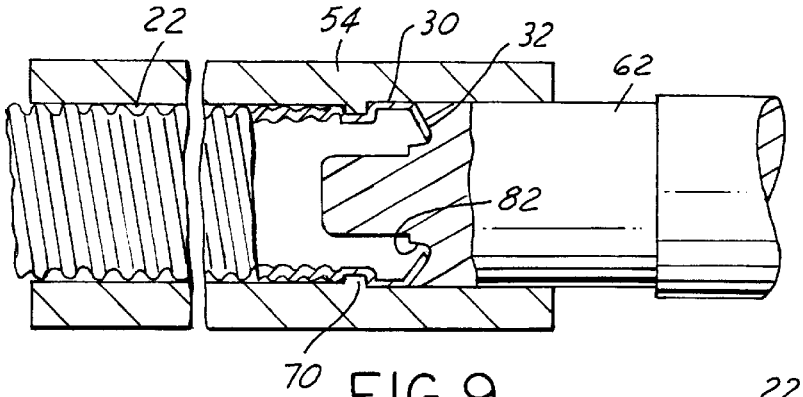
FIG. 9 is a fragmentary partially sectioned side elevational view of the fold-over tool in engagement with the tubing end as illustrated in FIG. 7.
Figure 9A:
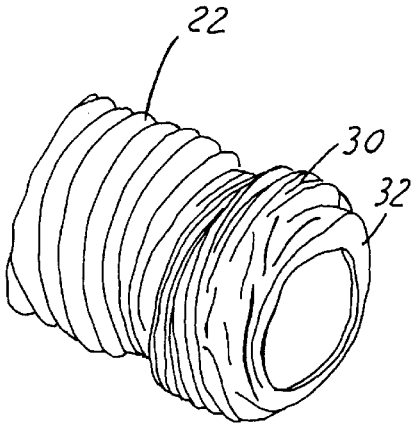
FIG. 9A is a fragmentary perspective view of the tubing end at the intermediate stage of manufacture after folding in FIG. 9.

With the tubing workpiece clamped in position between jaws 52, 54, fold-over end-form tool 62 is then brought into engagement with the end of the workpiece, by operation of actuator 64, as illustrated in FIG. 9. Fold-over end-form tool 62 comprises a substantially cylindrical body having a circumferentially continuous channel 82 formed in the axially facing end surface of the body. Channel 82 has a first substantially conical radially inner surface 84 extending radially and axially into tool 62 at an angle, such as 80°, to the axis of the tool. A second channel surface 86 extends from the rounded and concave inner end of surface 84 axially outwardly to the end surface of tool 62, preferably at a slight angle as on the order of 10° to the tool axis. When fold-over end-form tool 62 is brought into engagement with the previously crimped end portion 32 of the tubing body captured between jaws 52, 54, the axial end of crimped portion 32 is folded radially inwardly by sliding contact with surface 84 of channel 82 on tool 62. At the position in which tool 62 is fully engaged with the tubing, illustrated in FIG. 9, the end of the tubing is folded to a position extending radially inwardly into engagement with the inner end of surface 86. Tool 62 is then retracted. The slight angle of surface 86 allows tool 62 to be retracted without bending folded end portion 32 axially outwardly during such retraction. At this stage, tubing end portion 32 is folded radially inwardly, as illustrated in FIGS. 4 and 9A.

Shuttle 60 (FIG. 7) is then moved to the right under control of actuator 61 until compacting end-form tool 66 aligns with the tubing workpiece, which remains clamped between jaws 52, 54. Compacting end-form tool 66 is then extended by operation of actuator 64 to engage crimped and partially folded end portion 32 of the tubing workpiece. Compacting end 20 form tool 66 (FIGS. 10, 12 and 13) has an axially extending horn 90 with a cylindrical outer periphery dimensioned for close sliding fit within the inside diameter of channel 34 formed by rib segments 70 in clamping jaws 52, 54. Surrounding horn 90, an axially opening circumferential groove 92 is formed on the axial end face of tool 66. This channel 92 is formed by an annular lip 94 around the outer periphery of tool 66, and an annular surface or plateau 100 within lip 94. Plateau 100 is at greater diameter than horn 90, and blends into the outer surface of horn 90 by means of an angulated ramp surface portion 102.

Figure 13:
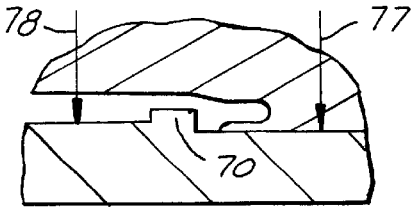
FIG. 13 is a fragmentary sectional view on an enlarged scale of the portion of FIG. 10 within the circle 13.

As tool 66 is extended into engagement with the tubing workpiece clamped between the jaws, the rounded nose of horn 90 engages and folds end portion 32 axially inwardly and then radially outwardly against the inside diameter of end portion 30. Material creases 48 help accommodate radial compaction and expansion of material during this operation. Further axial engagement of tool 66 with the workpiece brings the now fully folded end of the workpiece into channel 92 on the end of the tool. Inward motion of the tool is continued for axially compressing the formed end by bringing the corrugations of end portion 30 into axial abutment, and radially inward compaction of the formed end due to the tool lip 94 that surrounds channel 92. The outer periphery of tool lip 94 is on the cylinder of revolution that forms the periphery of tool 66 that is closely slidably received within clamping jaws 52, 54. As best seen in FIGS. 8 and 13, the inner diameter 77 formed by tools 52, 54 adjacent to the ends of the tools is greater than the inner diameter 78 on the opposite side of the rib segments 70. On the other hand, the inside diameter of plateau surface portion 100 on tool 66 is about the same as the inside diameter 78 of jaws 52, 54. In this way, when the end is fully formed, the outside diameter of end portion 24 will be about the same as the outside diameter of tube body 22. Furthermore, provision of ramp surface portion 102 and plateau 100 helps ensure that the inside diameter of the tube end portion or cuff is equal to or greater than the inside diameter of the remainder of the tube body so that the tube section can be readily slid over components to be located within the tube body. Compacting end-form tool 66 thus completes the folding operation started by fold-over end-form tool 62, and compacts the formed end of the tubing both axially and radially to complete formed end 24 (FIGS. 1 and 10A) having external end portion 30 and internal end portion 32 coupled to the body 22 of the tubing by circumferential channel 34.

There has thus been disclosed a method and apparatus for end-forming corrugated foil wrap tubing, and a length of corrugated foil wrap tubing having a formed end, that fully satisfy all of the objects and aims previously set forth. The invention has been disclosed in conjunction with a presently preferred embodiment, and a number of modifications and variations have been described. Other modifications and variations will readily suggest themselves to persons of ordinary skill in the art. The invention is intended to embrace all such modifications and variations as fall within the spirit and broad scope of the appended claims.

What is claimed is:

1. A method of forming an end of corrugated metal foil wrap tubing, which comprises the steps of:

(a) providing a length of tubing having a sidewall with spaced corrugations terminating at an end, and (b) folding a portion of said end into said sidewall to form a sidewall end having internal and external end portions, said step(b) comprising the steps of:

(b1) providing a first tool having an annular axially facing end channel, and (b2) bringing said first tool into axial engagement with said end of said tube so as to fold said internal end portion into said external end portion.

2. The method set forth in claim 1 comprising the additional step of: (c) compacting said sidewall end portions by axially compressing said external end portion to bring said corrugations into abutment with each other.

3. The method set forth in claim 2 wherein said step (c) comprises the step of continuing said axial engagement of said first tool with said end of said tubing such that said external end portion is captured and compacted within said end channel on said tool.

4. The method set forth in claim 3 comprising the additional step, prior to said step (b), of: (d) clamping said length of tubing between jaws for holding said tubing during contact with said first tool.

5. The method set forth in claim 4 comprising the additional step, prior to said step (b), of: (e) forming a channel around a periphery of said tubing adjacent to said end to isolate said end from the remainder of said length of tubing.

6. The method set forth in claim 5 wherein said step (e) is accomplished by providing rib segments on said jaws that, when said jaws are closed around said tubing in said step (d), form a circumferentially continuous rib to indent said channel into said tubing.

7. The method set forth in claim 4 wherein said step (b) comprises the additional steps, prior to said step (b1), of:

(b3) providing a second tool having an annular axially facing end channel, and (b4) bringing said second tool into axial engagement with said end of said tubing so as to fold said portion of said end toward a central axis of said tube, said portion of said tubing folded in said step (b4) being folded as said internal end portion into said external end portion in said step (b2).

8. The method set forth in claim 7 wherein said step (b) comprises the additional step, prior to said step (b3), of: (b5) crimping a portion of said end around a mandrel having an annular conical surface preparatory to folding said portion in said step (b4).

9. The method set forth in claim 1 wherein said step (b) comprises the additional steps, prior to said step (b1), of:

(b3) providing a second tool having an annular axially facing end channel, and (b4) bringing said second tool into axial engagement with said end of said tubing so as to fold said portion of said end toward a central axis of said tube, said portion of said tubing folded in said step (b4) being folded as said internal end portion into said external end portion in said step (b2).

10. The method set forth in claim 9 wherein said step (b) comprises the additional step, prior to said step (b3), of: (b5) crimping a portion of said end around a mandrel having an annular conical surface preparatory to folding said portion in said step (b4).

11. The method set forth in claim 10 wherein said step (b5) is accomplished by placing said length of tubing on said mandrel such that said portion of said end overlies said conical surface of said mandrel, and bringing crimping jaws into contact with said portion of said tubing to deform said portion over said conical surface.

12. A length of corrugated foil wrap tubing made in accordance with the method set forth in claim 1.

13. A length of corrugated foil wrap tubing made in accordance with the method set forth in claim 3.

14. A length of corrugated foil wrap tubing made in accordance with the method set forth in claim 9.

* * * * *